US006362460B1

(12) United States Patent
Fraker

(10) Patent No.: US 6,362,460 B1
(45) Date of Patent: Mar. 26, 2002

(54) WARMER-HOLDER FOR BODY APPLIED LIQUIDS

(76) Inventor: Andrea Fraker, 4184 Breckenridge, W. Bloomfield, MI (US) 48324

( * ) Notice: Subject to any disclaimer, the term of this patent is extended or adjusted under 35 U.S.C. 154(b) by 0 days.

(21) Appl. No.: 09/811,792

(22) Filed: Mar. 19, 2001

Related U.S. Application Data

(60) Provisional application No. 60/232,823, filed on Sep. 15, 2000.

(51) Int. Cl.[7] ..... H05B 3/06; F27B 14/10

(52) U.S. Cl. ..... 219/438; 219/521; 219/385

(58) Field of Search ..... 219/521, 438, 219/385, 386, 429, 433, 435, 436, 441; 392/392

(56) References Cited

U.S. PATENT DOCUMENTS 1,850,076 A * 3/1932 Hacker ..... 392/392
3,002,080 A * 9/1961 Heinzig ..... 392/392
3,666,914 A * 5/1972 Dean ..... 219/521
3,998,590 A * 12/1976 Glorieux ..... 219/439
4,659,911 A * 4/1987 Ryder et al. ..... 219/521
4,697,070 A * 9/1987 Kai ..... 219/521
5,796,914 A * 8/1998 Gatzemeyer et al. ..... 392/392
5,856,653 A * 1/1999 Boudreaux ..... 219/386

* cited by examiner

*Primary Examiner*—Joseph Pelham
(74) *Attorney, Agent, or Firm*—John R. Benefiel

(57) ABSTRACT

A warmer-holder for use with body applied liquids has a small volume open topped receptacle able to receive a few ounces of the liquid, the receptacle supported by prongs inserted into a wall outlet. A low power heater element is energized when the holder is plugged in to heat the liquid to temperature comfortable when applied to the person's body. A cover can be provided as well as an on-off switch for the heater element. The receptacle can have a simulated shape such as a seashell.

8 Claims, 3 Drawing Sheets

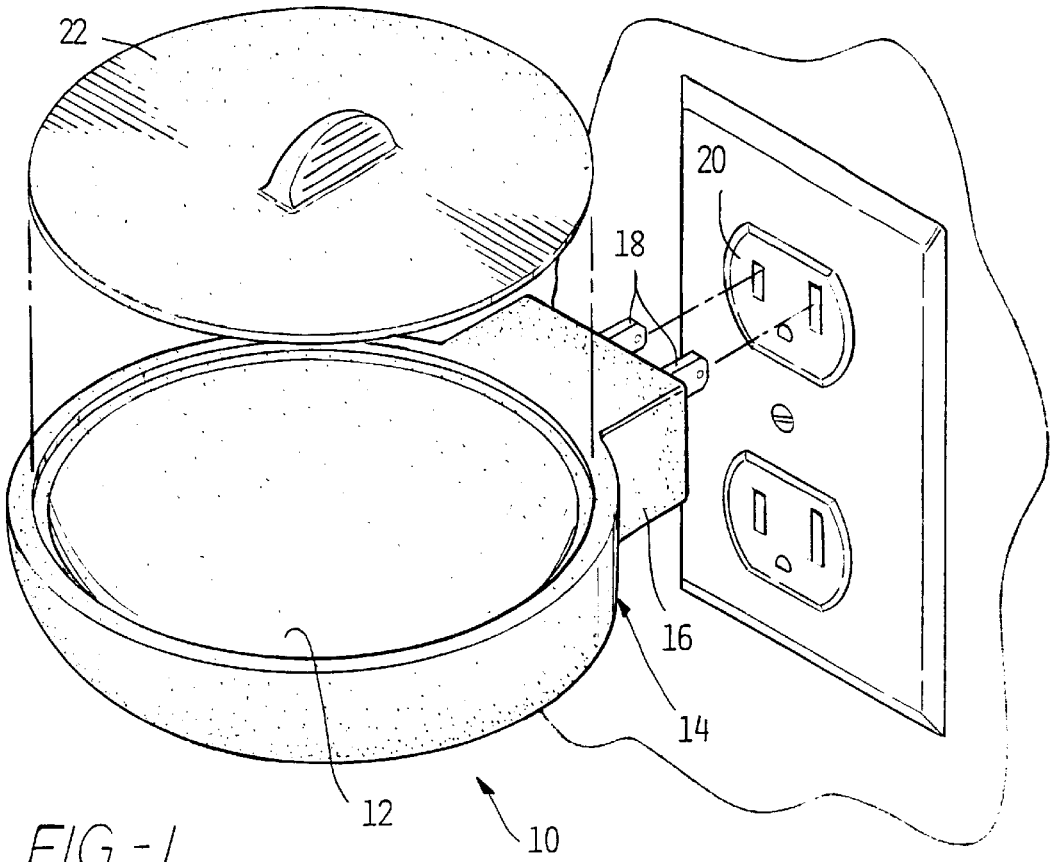
FIG-1
FIG-2
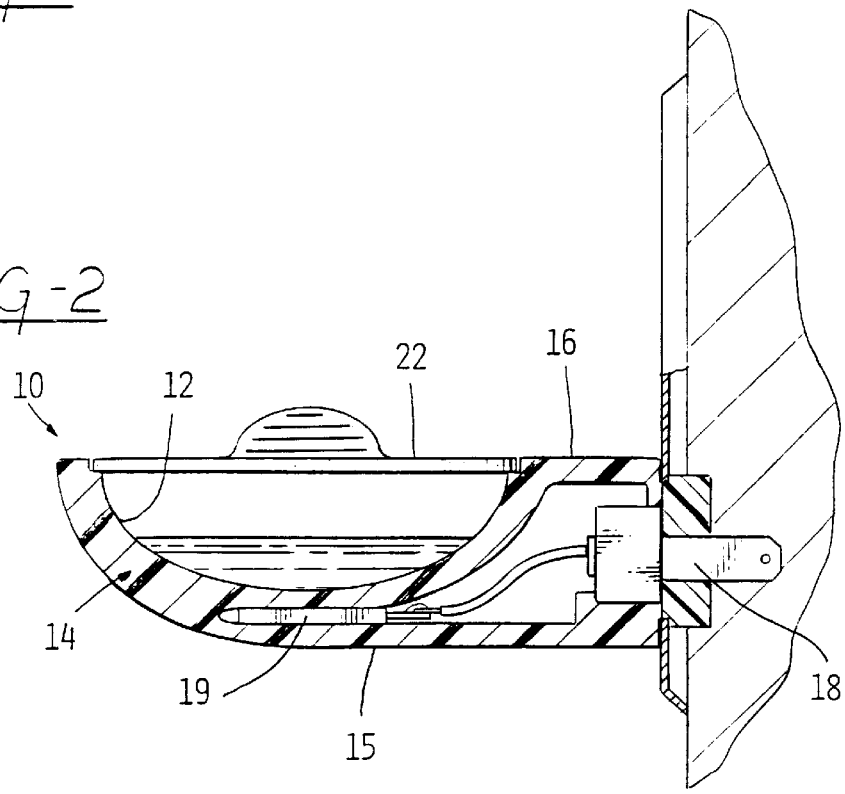

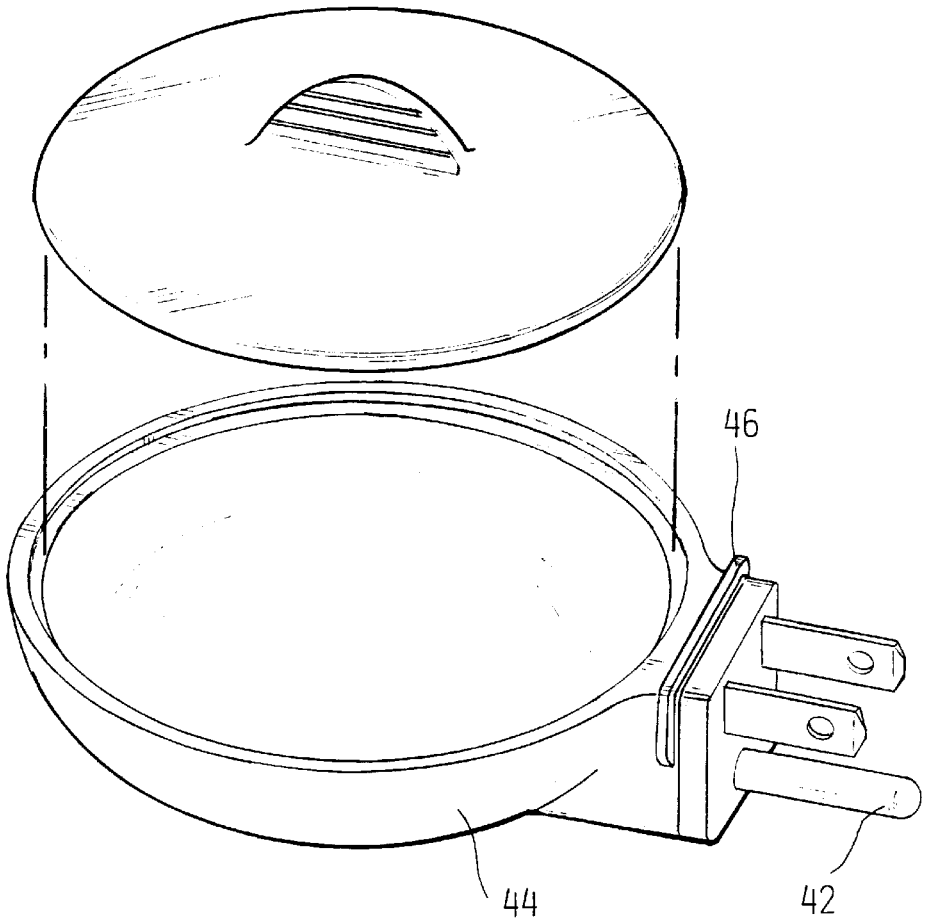
FIG - 5
FIG - 6
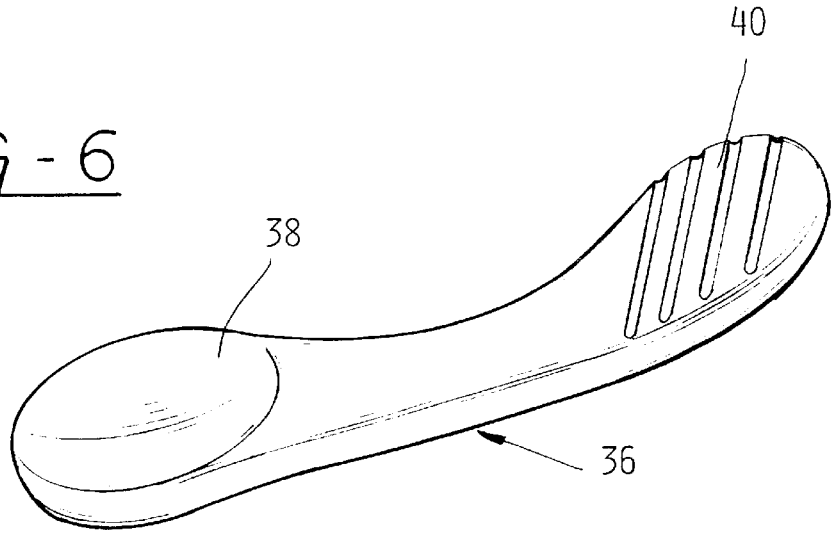

WARMER-HOLDER FOR BODY APPLIED LIQUIDS

CROSS REFERENCE TO RELATED APPLICATION

This application claims the benefit of provisional patent application Ser. No. 60/232,823, filed on Sep. 15, 2000.

BACKGROUND OF THE INVENTION

This invention concerns aids in applying lotions, creams and other liquids to a person's body. Such liquids are typically dispensed onto the fingers directly from a bottle or pump dispenser and then rubbed on the body. Since the lotion is usually applied unwarmed, this may cause some discomfort when the lotion is substantially colder than body temperature.

Large capacity preheaters for massage oils have previously been utilized, designed mainly for use by hospitals and professional masseurs.

Individuals wanting only to apply a small quantity of body lotion would not find such large capacity heaters suitable, due to their cost and, unaesthetic obtrusiveness, and since they take up space on the confined area of a typical bathroom vanity.

It is the object of the present invention to provide a device for warming small quantities of body lotions, creams, salves, and other body applied liquids, which is compact and unobtrusive as well as convenient to use.

SUMMARY OF THE INVENTION

The above recited object and others which will become apparent upon a reading of the following specification and claims are achieved by a warmer-holder comprised of a compact shallow dish receptacle integral with a housing so as to be held projecting from a wall surface by electrical prongs fixed to the housing inserted in wall electrical outlet. A low wattage heater is powered by insertion of the prongs into the outlet. A small volume of liquid poured into the shallow dish is warmed therein within a short time. The heater element can be either switched or unswitched, and optionally a cover can be provided for the dish receptacle. A lotion application paddle can be used in conjunction with the invention.

The housing has a flat bottom so as to be able to be rested securely on a vanity counter top or table after being pulled from the wall receptacle, for convenient access to the warmed lotion.

The shallow dish receptacle and housing are preferably designed to be aesthically compatible with a home bathroom decor.

DESCRIPTION OF THE DRAWINGS

FIG. 1 is an exploded perspective view of a warmer-holder for body applied liquids according to the invention together with fragmentary portions of a wall having an electrical outlet into which the warmer-holder is to be plugged.

FIG. 2 is partially vertical sectional view of the warmer-holder shown in FIG. 1, together with fragmentary portions of a supporting wall and electrical outlet.

FIG. 5 is a perspective view of another embodiment of the warmer-holder according to the invention.

FIG. 6 is a perspective view of a paddle applicator to be used with the warmer-holder according to the invention.

DETAILED DESCRIPTION

Figure 3:
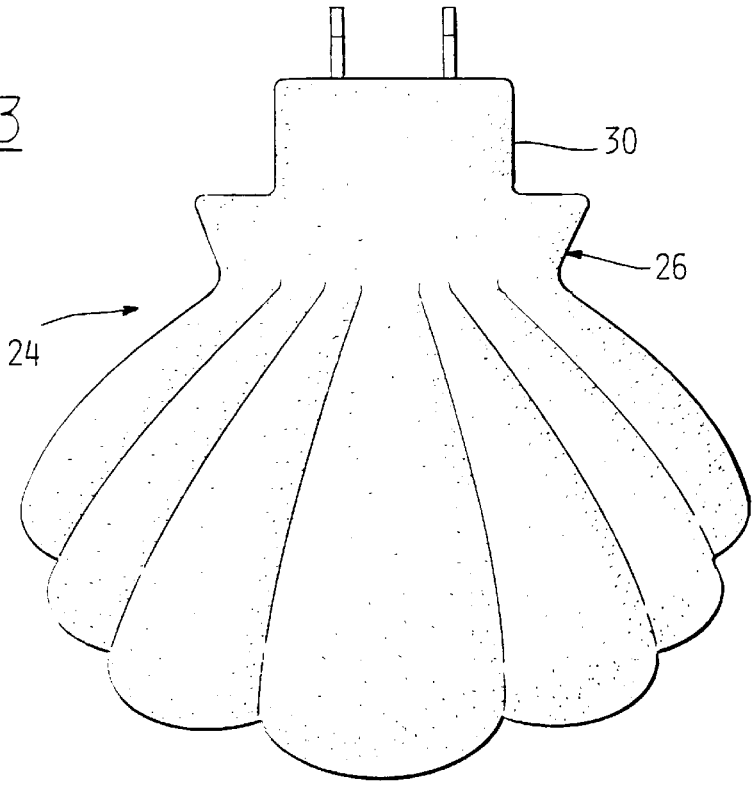
FIG. 3 is a bottom view of a second embodiment of a holder-warmer having a sea shell.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, and particularly FIGS. 1 and 2, the warmer-holder 10 according to the invention includes an open topped dish receptacle 12 integral with a housing 14. The receptacle 12 is preferably shallow and compact, on the order of a few, i.e., three inches in diameter and an inch or so deep so as to hold a small volume of liquid, i.e., several ounces.

The housing 14 has a portion 16 to the rear of the receptacle 12 which integrally supports electrical prongs 18 projecting to the rear thereof adapted to be inserted into a wall electrical outlet 20.

The housing 14 has a flat bottom 15 so as to be able to be rested securely on a table or vanity counter top when removed from the wall outlet 20.

The prongs 18 are electrically connected to a low wattage heater element 19 embedded in the housing 14 below the receptacle 12, of sufficient power to warm several ounces of lotion to a comfortable temperature (which may be in a range around body temperature or somewhat warmer) within a few minutes after being poured into the receptacle 12.

A cover 22 fit to the receptacle 12 can be also be provided to increase the rate of warming, and to allow more extended storage of a small volume of liquid.

Figure 4:
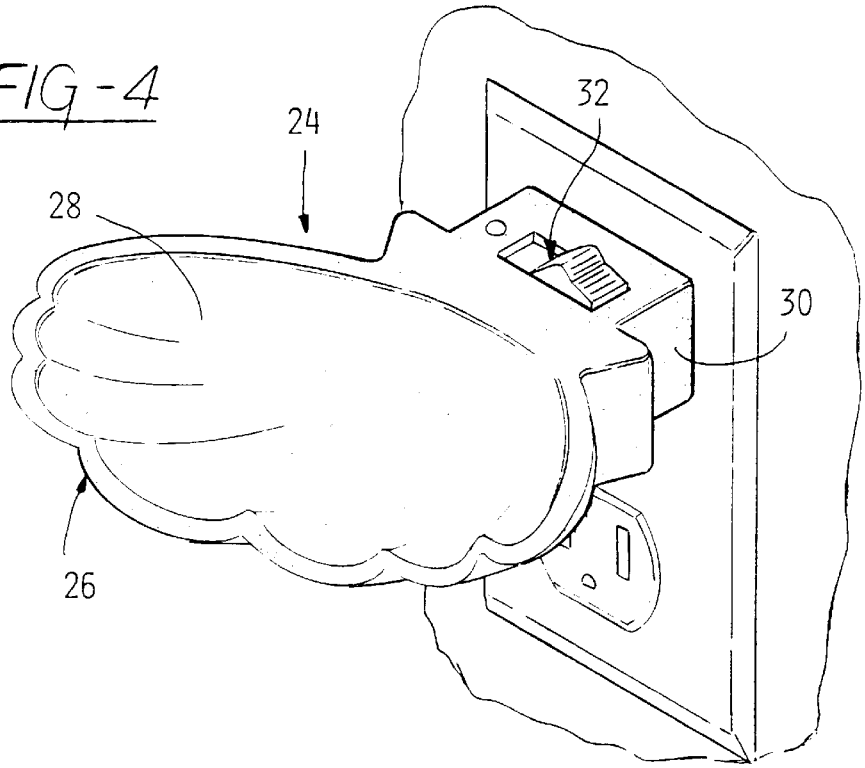
FIG. 4 is a perspective view of the embodiment of FIG. 3, together with a fragmentary portion of a wall having an electrical outlet in which the warmer-holder is plugged.

FIGS. 3 and 4 show a second embodiment of a warmer-holder 24 according to the present invention in which the housing 26 defining an open topped dish receptacle 28 is shaped as a sea shell to be compatible with typical home bathroom decor. Many other such design shapes are of course possible.

In this embodiment, the rear portion 30 of the housing 26 is enlarged to accommodate an on-off switch 32 for the heater element 19.

FIG. 5 shows another embodiment in which a grounding prong 42 is also included to ground the warmer housing 44 and also provide additional support when the warmer-holder 26 plugged in to a wall outlet. An anti-splash ridge 46 is also molded into the housing 44 to block liquid from reaching the prongs and outlet.

FIG. 6 shows a flat paddle 36 having a dished end 38 and a ribbed grip end 40, which paddle 36 can be used by repeatedly dipping the dished end 38 into the warmed liquid while holding the grip end 40 to remove a small volume of warmed liquid to be applied with the fingers.

Accordingly, a conveniently useable warmer-holder suitable for this application has been provided, which is simple and compact, and compatible with home bathroom decor and reduces clutter on a vanity top.

What is claimed is:

1. A warmer-holder for body applied liquids comprising a shallow open topped liquid dish receptacle having a diameter on the order of three inches in diameter and a much shallower depth formed by a housing; a pair of integrally fixed receptacle with prongs mateable with an electrical wall outlet projecting from said housing; and a heater element in said housing electrically connected to said prongs so as to warm liquid poured into said energized by insertion of said prongs into a wall outlet, said housing supported thereby to dispense said receptacle facing upwardly and against a wall in which said outlet is located, whereby said liquid is held in a warmed state ready for application to a user's body.

2. The warmer-holder according to claim 1 wherein said receptacle has a depth on the order of an inch.

3. The warmer-holder according to claim 2 wherein said receptacle holds a volume on the order of several ounces of liquids.

4. The warmer-holder according to claim 1 further including a cover placeable on said open topped receptacle.

5. The warmer-holder according to claim 1 further including an on-off switch mounted to said housing controlling operation of said heater element.

6. The warmer-holder according to claim 1 wherein said housing includes a simulated sea shell portion.

7. The warmer-holder according to claim 1 wherein said heater element is low powered to be able heat several ounces of liquid to a comfortable temperature in a few minutes.

8. A method of warming and holding a small volume of liquid to be applied to a person's body comprising the steps of supporting a small open topped receptacle on electrical prongs fixed to said receptacle and inserted into a wall outlet, thereby energizing a low power heater element adjacent said receptacle able to warm a liquid to a temperature comfortable to the touch and, pouring a few ounces of liquid into said receptacle to be warmed therein ready for use in applying to a person's body.

* * * * *